US011827958B2

(12) United States Patent
Huang et al.

(10) Patent No.: US 11,827,958 B2
(45) Date of Patent: Nov. 28, 2023

(54) MAGNESIUM ALLOY, PREPARATION METHOD THEREOF, AND PROCESS FOR PREPARING WHEELS BY USING THE MAGNESIUM ALLOY

(71) Applicant: CITIC Dicastal Co., Ltd., Qinhuangdao (CN)

(72) Inventors: Lixin Huang, Qinhuangdao (CN); Zhihua Zhu, Qinhuangdao (CN); Shiwen Xu, Qinhuangdao (CN); Jingru Shen, Qinhuangdao (CN); Liguang Xie, Qinhuangdao (CN); Naizheng Hu, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 2 days.

(21) Appl. No.: 17/576,294

(22) Filed: Jan. 14, 2022

(65) Prior Publication Data

US 2023/0193433 A1 Jun. 22, 2023

(30) Foreign Application Priority Data

Dec. 16, 2021 (CN) ..... 202111536766.8

(51) Int. Cl.
*C22C 23/02* (2006.01)
*C22C 1/03* (2006.01)
*C22F 1/06* (2006.01)

(52) U.S. Cl.
CPC ..... *C22C 23/02* (2013.01); *C22C 1/03* (2013.01); *C22F 1/06* (2013.01)

(58) Field of Classification Search
CPC ..... C22C 23/00; C22C 23/02
(Continued)

(56) References Cited

U.S. PATENT DOCUMENTS

2009/0068053 A1* 3/2009 Ma ..... C22C 1/02 164/121

FOREIGN PATENT DOCUMENTS

CN 102418020 A * 4/2012
EP 3650561 A1 * 5/2020 ..... B22D 15/00
JP 2008308703 A * 12/2008

OTHER PUBLICATIONS

NPL: online translation of CN-102418020-A, Apr. 2012 (Year: 2012).*

(Continued)

*Primary Examiner* — Jie Yang
(74) *Attorney, Agent, or Firm* — IPRO, PLLC

(57) ABSTRACT

The disclosure discloses a high-speed spinning magnesium alloy and a preparation method thereof, the magnesium alloy has Mg—Al—Zn—Mn—Sr alloy with a high formability and high strength, and its chemical composition mass percentage is: Al: 2.4-4.5 wt. %; Zn: 0.6-1.2 wt. %; Mn: 0.4-0.6 wt. %; Sr: 0.15-0.3 wt. %; the balance is Mg. The present disclosure adopts the principle that by increasing the content of Mn in the magnesium alloy, a large amount of Mn-rich phase is generated during the alloy preparation process, and the degree of subcooling is controlled so that a fine spherical dispersed nano-scale Mn-rich phase is obtained during the solidification process. The nano-scale Mn-rich precipitate phase can pin the grain boundaries and inhibit the grain boundary migration to refine grains and achieve the effect of improving the strength. The divorced eutectic $Mg_{17}Al_{12}$ phase generated during the casting process will deteriorate the structure, so Sr is added to the alloy, Sr combining with Al to suppress the coarse phase of divorced eutectic $Mg_{17}Al_{12}$, refine the grains, increase the amount of eutectic, and reduce the risk of thermal cracking of large-size cast bars. In addition, Sr weakens the texture during the high-temperature spinning forming process and reduces the risk
(Continued)

of cracking during the spinning tension, which is beneficial to high-speed spinning forming.

8 Claims, 3 Drawing Sheets

(58) Field of Classification Search
USPC ..... 420/409
See application file for complete search history.

(56) References Cited

OTHER PUBLICATIONS

NPL: online translation of JP-2008308703-A, Dec. 2008 (Year: 2008).*

* cited by examiner

MAGNESIUM ALLOY, PREPARATION METHOD THEREOF, AND PROCESS FOR PREPARING WHEELS BY USING THE MAGNESIUM ALLOY

TECHNICAL FIELD

The disclosure relates to the field of metal materials and metal material processing, in particular to a magnesium alloy and a preparation method thereof and a process for preparing wheels using the magnesium alloy.

BACKGROUND

In many factories, engineers tend to produce structural products with high strength and low weight. Therefore, magnesium alloy has the advantages of high specific strength and rigidity, shock absorption, electromagnetic shielding and radiation resistance, easy cutting processing, and green recycling. It attracts many researchers and is used in important industrial fields, such as aerospace, automobiles, transportation, etc. In addition, compared with other metals, magnesium alloys also have unique properties, such as the advantages of easy cutting and green recycling. Even so, the traditional magnesium alloy hot-rolled sheet has a strong texture. Compared with aluminum alloys, the cold deformation ability of magnesium alloy is much weaker, which limits the development of magnesium alloys.

In recent years, magnesium alloy wheels have been developed step by step and used in automobiles. Magnesium alloy wheels are mainly divided into cast magnesium alloy wheels and forged magnesium alloy wheels. Because of higher strength and no obvious casting defects, the forged magnesium alloy wheels have been applied earlier. Some magnesium alloy wheels are gradually reported at home and abroad. Such as the forged magnesium alloy wheels of F1 racing cars. At present, MgAl series alloys are widely used, main commercial alloy grades are such as AZ31, AZ80, AZ91, among which most of the forged magnesium alloy wheels are AZ80 grades, but because of the poor deformability of AZ80, only traditional forging processes can be used. However, the traditional forging process will bring two serious problems. The first is that forging requires large-tonnage equipment, and the second is that the rim of the wheel leads to a large margin of forging materials and low metal utilization. Therefore, a material that can be spun by a small tonnage spinning equipment is needed to improve metal utilization, fundamentally reducing the cost of materials.

SUMMARY

In view of this, the present disclosure aims to provide a new type of magnesium alloy and a method for preparing magnesium alloy products suitable for high-speed spinning process, so that the magnesium alloy has good shaping and deformability and has excellent strength and plasticity after forming. Meanwhile, the cost of the raw materials and processing is low, and it is easy to realize mass production.

A magnesium alloy, comprising the mass percentages of: Al: 2.4-4.5 wt. %; Zn: 0.6-1.2 wt. %; Mn: Sr: 0.15-0.3 wt. %, the balance is Mg.

In some embodiments, unavoidable impurities are also comprised.

A method for preparing the above-mentioned magnesium alloy, comprising the following steps: (1) batching, in terms of mass percentage: Al: 2.4-4.5 wt. %; Zn: 0.6-1.2 wt. %; Mn: 0.4-0.6 wt. %; Sr: the balance is Mg for batching; (2) smelting, putting the pure Mg ingot into the crucible of the smelting furnace, setting the furnace temperature at 700-730° C. and keeping it, adding the pure Al block and pure Zn block preheated to 50-80° C. into the magnesium solution after smelting, then raising the smelting temperature to 770-780° C., and adding the Mg—Mn master alloy and Mg—Sr master alloy preheated to 120-160° C. into the magnesium solution respectively; then raising the smelting temperature to 780° C., keeping the temperature for 5-15 minutes, then stirring for 3-10 minutes, and introducing the high-purity Ar gas for refining and degassing, adjusting and controlling the temperature at 710° C.-730° C., keeping the temperature for 2-10 minutes; (3) pouring, the pouring temperature is controlled above 680° C.; (4) stress relief treatment, keeping the temperature at 280-320° C. for 8-12 h, then air cooling; (5) extruding and deforming, heating the stress-relieved magnesium alloy to 300-410° C. within 30 minutes, then putting the magnesium alloy into a die for deforming; the extrusion speed being 1-10 m/min, air cooling after deforming processing.

In some embodiments, the smelting process is carried out under the protection of a mixture of $CO_2$ and $SF_6$ gas.

In some embodiments, after the smelting is completed, the surface scum needs to be removed and pour into a die to obtain a magnesium alloy.

In some embodiments, after the stress relief treatment, the processes of cutting into blanks and peeling are also comprised before extrusion.

In some embodiments, the stirring in the smelting process comprises mechanical stirring and argon stirring.

In some embodiments, the Al—Mn master alloy is a Mg-10Mn master alloy, and the Mg—Sr master alloy is a Mg-25Sr master alloy.

In some embodiments, the gas mixture of CO2 and SF6 has a composition volume ratio of 50-100:1.

A process for preparing wheels according to the above-mentioned magnesium alloy comprises the following steps: (1) forging on a 6000-ton forging equipment; (2) spinning the wheel rim, the spinning temperature is 300° C.-380° C., the rotary wheel feeding speed is 350-450 mm/min, the wall thickness reduction rate is 60-75%, and the spindle speed is 300-400 r/min.

Compared with the prior art, the present disclosure has the following remarkable advances and advantages:

The magnesium alloy of the present disclosure takes Al element, Zn element and Mn element as the main alloying elements, supplemented by trace Sr element as the alloying process, and utilize the obtained nano-level Mn-rich precipitation phase and nano-MgZnSr precipitation phase during the homogenization process, and Sr to weaken texture through particle-promoting nucleation mechanism, and improve the anisotropy and deformation ability of magnesium alloys at room temperature, thereby enhancing the strength and plastic deformation ability of the alloy.

Under pouring conditions, the obtained magnesium alloy material has an average tensile yield strength of 67.1 MPa, an average tensile strength of 208 MPa, and an average elongation of 20.1%, at room temperature. The current commercial AZ31 magnesium alloy grade, under the same casting conditions, has a tensile yield strength of 51.3 MPa, a tensile strength of 121 MPa, and an average elongation of 8%, at room temperature.

Obtain the plastic deformation magnesium alloy material at room temperature, and prepare the magnesium alloy extruded bar through the extrusion process. The average tensile yield strength of the extruded bar in the axial direction of the bar reaches 223 MPa, the average tensile strength reaches 283 MPa, and the average elongation rate is 10.5%, at room temperature. By the way, the current commercial AZ31 magnesium alloy grade, under the same extrusion conditions, the average tensile yield strength of the extruded bar in the axial direction of the center is 137 MPa, the tensile strength is 243 MPa, and tensile elongation at room temperature is only 7%.

The plastic deformation magnesium alloy material at room temperature is obtained, and the magnesium alloy product is prepared through the forging spinning process after extrusion. The spinning temperature range can reach 300° C.-380° C., the rotary wheel feeding speed is 350-450 mm/min, and the wall thickness reduction rate is 60-75%, the spindle speed is up to 400 r/min, and the spinning product rate reaches 95%. At present, the commercial AZ31 magnesium alloy grade has a spinning temperature range of 350° C.-380° C., a rotary wheel feeding speed of 250-300 mm/min, a wall thickness reduction rate of 40-60%, a spindle speed of up to 300 r/min, and the spinning product rate is only 70%.

2) The magnesium alloy of the present disclosure contains only a small amount of Sr, the MgMn master alloy is cheap, and the alloy cost is low (MgSr master alloy is generally 70 RMB per kilogram, while the MgMn master alloy used in this patent is only about 55 RMB per kilogram); in addition to being prepared into magnesium alloy wheels, it can also be widely used to produce automobile parts such as car window frames and seat frames; it can also be extruded into various types of materials as parts blanks in the aerospace field.

3) The magnesium alloy preparation process of the present disclosure is simple, breaks through the limitation of special processing modes such as large plastic deformation required by most high strength and toughness magnesium alloys, and the existing magnesium alloy extrusion equipment can continuously process and produce the magnesium alloy without additional improvement, and has low requirements on production equipment.

BRIEF DESCRIPTION OF THE DRAWINGS

The drawings constituting a part of the present disclosure are used to provide a further understanding of the present disclosure, and the schematic embodiments and descriptions of the present disclosure are used to explain the present disclosure, and do not constitute an improper limitation of the present disclosure. In the attached drawings.

DETAILED DESCRIPTION

Figure 1:
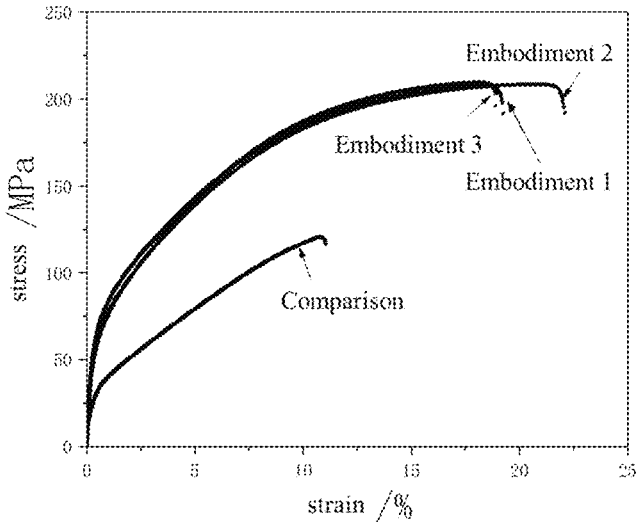
FIG. 1 is the stress-strain curve of the as-cast room temperature tensile test of the magnesium alloy of the present disclosure and the comparative example.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The technical solutions of the present disclosure will be clearly and completely described below with reference to the drawings and in conjunction with the embodiments. Obviously, the described embodiments are only a part of the embodiments of the present disclosure, rather than all the embodiments. Based on the embodiments of the present disclosure, all other embodiments obtained by those of ordinary skill in the art without creative work shall fall within the protection scope of the present disclosure.

The alloy is a new type of high-speed spinning Mg—Al—Zn—Mn—Sr alloy.

The technical solution of the present disclosure is: a magnesium alloy, the alloy is Mg—Al—Zn—Mn—Sr alloy, and its chemical composition mass percentage is: Al: 2.4-4.5 wt. %; Zn: 0.6-1.2 wt. % Mn: 0.4-0.6 wt. %; Sr: 0.15-0.3 wt. %, the balance is Mg and unavoidable impurities.

A method for preparing the above-mentioned magnesium alloy comprises the following steps.

(1) Batching: using pure Mg ingots, pure Al blocks, pure Zn blocks, Mg—Mn master alloys, and Mg—Sr master alloys as raw materials, and batching according to the magnesium alloy composition.

(2) Smelting: putting the pure Mg ingot into the crucible of the smelting furnace, setting the furnace temperature to 700-730° C. and keeping it, adding the pure Al block and pure Zn block preheated to 50-80° C. into the magnesium solution after smelting, then raising the melting temperature to 770° C., and adding the Mg—Mn master alloy and Mg—Sr master alloy preheated to 140° C. to the magnesium solution respectively; then raising the smelting temperature to 780° C., keeping it for 10 minutes, then stirring for 5 minutes, and introducing the high-purity Ar gas for refining and degassing, adjusting and controlling the temperature at 720° C., keeping the temperature for 5 minutes; the smelting process is carried out under the protection of a mixed gas of $CO_2$ and $SF_6$.

(3) Pouring: removing the surface scum and pouring the magnesium alloy solution into the corresponding die to prepare the as-cast magnesium alloy; the pouring process does not require gas protection, and the pouring temperature is controlled above 700° C.

(4) Stress relief treatment: keeping the temperature at 280-320° C. for 8-12 h, then air cooling; the heating and heat preservation process of the stress relief treatment does not need gas protection.

The stress-relieving treatment ingot obtained in the previous step is cut into corresponding blank and peeled.

(5) Extruding and deforming: heating the blank obtained in the previous step to 360° C. within 30 minutes, and then putting into a die for deforming; the extrusion speed is 1-10 m/min, air cooling is carried out after deforming, and the described plastic magnesium alloy material is finally obtained.

The stirring in the above smelting is mechanical stirring or argon blowing stirring.

The Mg-Mn master alloy is an Al-10Mn master alloy.

The Mg-Sr master alloy is a Mg-25Sr master alloy.

The composition volume ratio of the mixed gas of $CO_2$ and $SF_6$ is 100:1.

A process for preparing products according to the above-mentioned magnesium alloy, comprising the following steps: (1) forging and spinning: forging the shaped magnesium alloy material described in the previous step on a 6000-ton forging equipment at a forging temperature of 390-420° C.; (2) spinning the wheel rim after forging, the spinning temperature range can reach 300° C.-380° C., the feeding rate of the rotary wheel is 350-450 mm/min, the wall thickness reduction rate is 60-75%, and the spindle speed can reach 300-400 r/min. The spinning speed finally obtains the magnesium alloy wheel hub. The die is a die for forming bars, plates, tubes, wires or profiles.

The present disclosure is characterized in that: grain refinement can be generally adopted in the magnesium alloy, and quantity and size of precipitated strengthening phase in the alloy can by adjusted to improve the room temperature strength and plasticity of the alloy, such as optimizing the alloy texture, etc.

The technical principle of the present disclosure is: the alloy contains Al, Zn, Mn, and Sr elements. The Al—Mn primary phase is obtained during the alloy casting process and the Mg—Zn—Sr precipitated phase is obtained during the homogenization of the alloy. The spherical Al—Mn primary phase and Mg—Zn—Sr precipitated phase can pin the grain boundary and inhibit the grain boundary migration, the Sr will also combine with Al in the Mg matrix reducing the solid solution of Al in the Mg matrix. Meanwhile, it can also improve the morphology and distribution of the $Mg_{17}Al_{12}$ phase during the solidification process, which will weaken the texture and increase the strength and shaping deformation.

In the present disclosure, Al: 2.4-4.5 wt. %: when the content of Al is less than 2.0 wt. %, the Al is completely solid-dissolved in the magnesium matrix and cannot form a precipitation phase with Mn, and does not have a strengthening effect; when the content of Al is greater than 4.5 wt. %, the Al element will be enriched at the grain boundary, forming a coarse network of divorced eutectic $Mg_{17}Al_{12}$ phase at the grain boundary, which is harmful to the strength and shaping of the material. It has been proved repeatedly in practice that materials with too high Al content are prone to fracture during spinning.

In the present disclosure, Zn: 0.6-1.2 wt. %; an appropriate amount of Zn will combine with Al and Sr to form a precipitation phase with a higher strengthening effect.

In the present disclosure, Mn: 0.4-0.6 wt. %; when the Mn content is less than 0.3 wt. %, the amount of formed Mn-rich phase is small, which is not enough to hinder the growth of grains, and the reinforcement is limited; when the content of Mn is greater than 0.6 wt. %, the formed Mn-rich phase is easy to segregate, and is easy to grow and coarsen under the subsequent high temperature conditions, which damages the shaping deformation and easily causes material cracking.

In the present disclosure, Sr: 0.15-0.3 wt. %; Sr is added because it is found that after Sr atoms are solid-dissolved in the magnesium alloy matrix, it will suppress the precipitation of the reticulated divorced eutectic $Mg_{17}Al_{12}$ phase, and meanwhile it will promote the precipitation of the AlMn nanophase, and weaken texture and improve plasticity.

The disclosure finally obtains the wrought magnesium alloy material, and quickly prepares the magnesium alloy wheel hub through the forging spinning process, and the product rate reaches 95%.

Conventional Al—Zn—Mn alloy (AZ31 alloy: Al: 2.5-3.5 wt. %; Zn: 0.6-1.4%; Mn: 0.12-1.0%) is used to prepare a magnesium alloy wheel by the same forging spinning process. The interval is narrow, the quality stability is poor, and the rim (spinning area) of some wheels has horizontal micro-cracks, and the product rate is about 70%.

Three alloy compositions: Mg-2.42Al-0.71Zn-0.52Mn-0.155r (wt. %) (alloy 1), Mg-4.47Al-1.09Zn-0.58Mn-0.285r (wt. %) (alloy 2), and Mg-3.35Al-0.92Zn-0.43Mn-0.215r (wt. %) (alloy 3) are selected as a typical example. According to the technical solution of the present disclosure, the pure Mg (99.8 wt. %) ingots, pure Al (99.9 wt. %) ingots, pure Zn (99.9 wt. %) ingots, MgMn master alloys, Mg-25Sr (the actual detected content of Sr is 25.35 wt. %) master alloys are taken as the alloying raw material and smelted to prepare low-cost magnesium alloy pour bars; after stresse-relieving and peeling is put into an induction heating furnace and quickly heated to the extrusion temperature of 320-380° C., and then the magnesium alloy pouring is deformed into bars by extrusion processing, with the extrusion speed of 4.5-7.2 m/min, the extrusion ratio of 2, and air-cooling the extruded bars; then the material is forged and spun to processed a magnesium alloy wheel product, the mechanical properties of the alloy cast bar and the rim on the wheel are tested simultaneously. The as-cast and deformed mechanical properties of the example and comparison AZ31 at room temperature are shown in table 1 and table 2, respectively.

Embodiment 1: the Mg-2.42Al-0.71Zn-0.52Mn-0.15Sr (wt. %) alloy composition ratio is selected to form a magnesium alloy. The preparation method comprises the following steps.

(1) Batching: using pure Mg ingots, pure Al blocks, pure Zn blocks, MgMn master alloys, and MgSr master alloys as raw materials, and batching according to the above-mentioned target composition.

(2) Smelting: putting the pure Mg ingot into the crucible of the melting furnace, setting the furnace temperature to 710° C. and keeping it, adding the pure Al and pure Zn blocks preheated to 65° C. into the magnesium solution after smelting, then raising the melting temperature to 760° C., adding the MgMn master alloy preheated to 65° C. and the MgSr master alloy preheated to 140° C. into the magnesium solution respectively, keep it for 15 minutes, then stirring for 5 minutes, and introducing the high-purity Ar gas for refining and degassing, adjusting and controlling the temperature at 720° C. for 8 minutes; the smelting process is carried out under the protection of a mixed gas of $CO_2$ and $SF_6$.

(3) Pouring: removing the surface scum and pouring the magnesium alloy solution into the corresponding die to prepare the as-cast magnesium alloy; the casting temperature is controlled above 700° C., and the pouring process does not require gas protection.

(4) Stress relief treatment: keeping the temperature at 300° C. for 10 h, and then air-cooling.

The stress-relieving ingot obtained in the previous step is cut into corresponding blanks and peeled.

(5) Extruding and deforming: heating the blank obtained in the previous step to 380° C. within 30 minutes, then putting the blank into a die for deforming; the extrusion speed is 4.5 m/min, and air cooling is carried out after deforming and the plastic magnesium alloy material is finally obtained.

The preparation of the wheel from the above-mentioned magnesium alloy materials comprises forging and spinning: (1) forging the shaped magnesium alloy materials described in the previous step on a 6000-ton forging equipment with a forging temperature of 380° C.; (2) spinning the wheel rim at a spinning temperature of 340° C. after forging, the feeding speed of the spinning wheel is 400 mm/min, the wall thickness reduction rate is 65%, and the spindle speed is 400 r/min. Finally, the magnesium alloy wheel hub is obtained.

A sample with a length of 90 mm is cut from the alloy cast bar obtained in Embodiment 1, and processed into a round bar-shaped tensile sample with a diameter of 5 mm and a gauge length of 25 mm for the tensile test. It is measured that the tensile strength of the magnesium alloy of the present disclosure is 208 MPa, the yield strength is 70.2 MPa, and the elongation is 19.2%, as shown in table 1. The magnesium alloy obtained in this embodiment has both high strength and high elongation. The typical tensile curve of the magnesium alloy obtained in this example is shown in FIG. 1.

Figure 2:
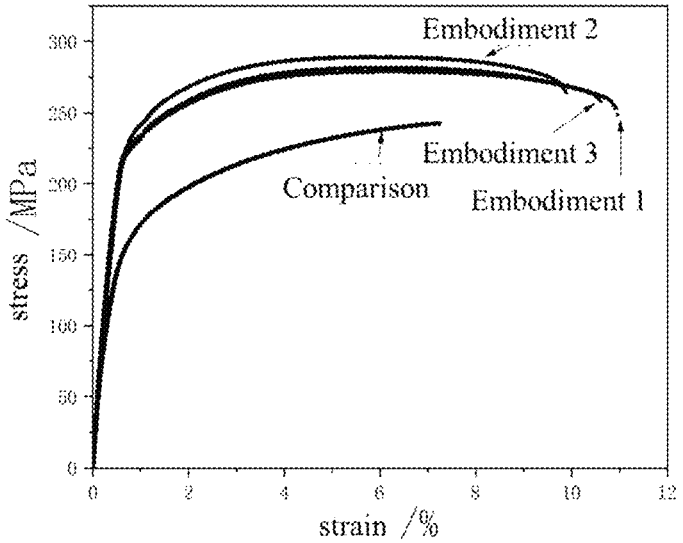
FIG. 2 is the stress-strain curve of the modified form room temperature tensile test of the magnesium alloy of the embodiment of the present disclosure and the comparative example.
Figure 3:
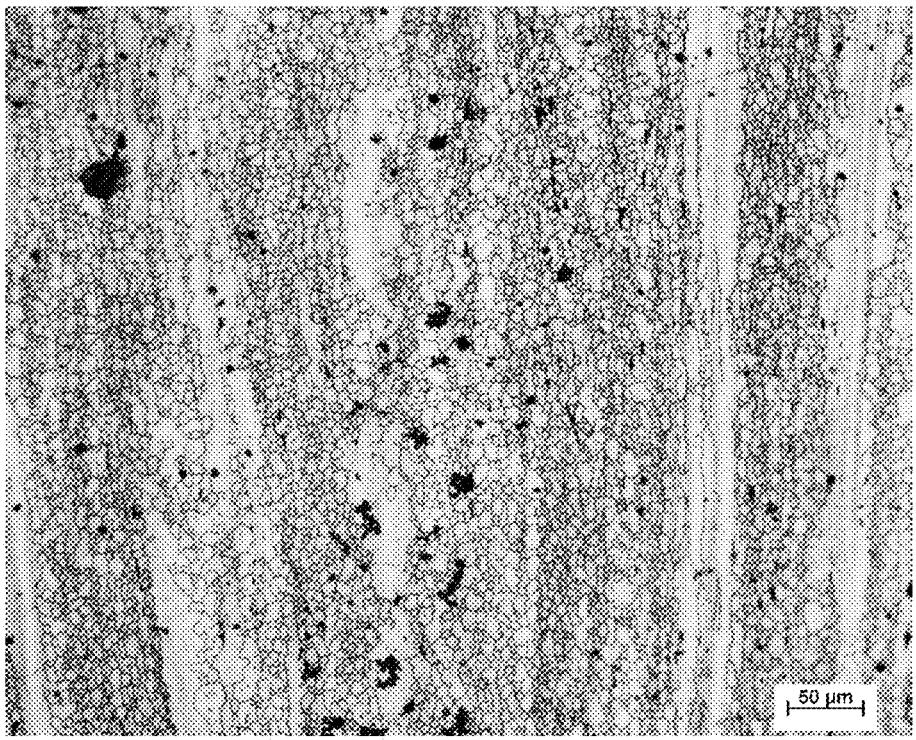
FIG. 3 is a microstructure of embodiment 1 parallel to the extrusion direction.

A sample with a length of 90 mm is cut from the upper rim part (spinning area) of the hub obtained in embodiment 1, and processed into a round bar-shaped tensile sample with a diameter of 5 mm and a gauge length of 25 mm for the tensile test. The axial direction of the sample bar is the same as the extrusion streamline direction of the material. It is measured that the tensile strength of the magnesium alloy of the present disclosure is 282 MPa, the yield strength is 223 MPa, and the elongation rate is 11%, as shown in table 2. The magnesium alloy obtained in this embodiment has both high strength and high elongation. The typical tensile curve of the magnesium alloy obtained in this example is shown in FIG. 2. FIG. 3 is a microstructure morphology of the Mg-2.42Al-0.71Zn-0.52Mn-0.15Sr (wt. %) magnesium alloy obtained in this embodiment parallel to the extrusion direction. It can be seen that the alloy undergoes dynamic recrystallization during the spinning process, and the proportion of fine grains accounts for 90%.

Embodiment 2: The Mg-4.47Al-1.09Zn-0.58Mn-0.28Sr (wt. %) alloy composition ratio is selected to form a magnesium alloy. The preparation method comprises the following steps.

(1) Batching: using the pure Mg ingots, pure Al blocks, pure Zn blocks, MgMn master alloys, and MgSr master alloys as raw materials, and batching according to the above-mentioned target composition.

(2) Smelting: putting the pure Mg ingot into the crucible of the smelting furnace, setting the furnace temperature at 710° C. and keeping it, adding the pure Al block and pure Zn block preheated to into the magnesium solution after smelting, then raising the smelting temperature to 760° C., adding the MgMn master alloy preheated to 60° C. and the MgSr master alloy preheated to 120° C. into the magnesium melt respectively, keeping it for 15 minutes, then stirring for 5 minutes, and introducing the high-purity Ar gas for refining and degassing, adjusting and controlling the temperature at 720° C. for 10 minutes; the smelting process is carried out under the protection of a mixed gas of $CO_2$ and $SF_6$.

(3) Pouring: removing the surface scum and pour the magnesium alloy solution into the corresponding die to prepare the as-cast magnesium alloy; the casting temperature is controlled above 700° C., and the casting process does not require gas protection.

(4) Stress relief treatment: keeping the temperature at 320° C. for 8 h, then air cooling.

The ingot after solution treatment obtained in the previous step is cut into corresponding blanks and peeled them.

(5) Extruding and deforming: heating the blank obtained in the previous step to 380° C. within 30 minutes, then putting into a die for deformation processing; the extrusion speed is 6 m/min, air cooling is carried out after deforming and the plastic magnesium alloy material is finally obtained.

The preparation of wheels from the above-mentioned magnesium alloy materials comprises forging and spinning: (1) forging the shaped magnesium alloy materials described in the previous step on a 6000-ton forging equipment with a forging temperature of 380° C.; (2) spinning the wheel rim after forging, the spinning temperature is 380° C., the feeding speed of the spinning wheel is 450 mm/min, the wall thickness reduction rate is 75%, and the spindle speed is 300 r/min. Finally, the magnesium alloy wheel hub is obtained.

A sample with a length of 90 mm is cut from the cast bar obtained in Embodiment 2 and processed into a round bar-shaped tensile sample with a diameter of 5 mm and a gauge length of 25 mm for the tensile test. It is measured that the tensile strength of the magnesium alloy of the present disclosure is 209 MPa, the yield strength is 65.7 MPa, and the elongation is 22.1%, as shown in table 1. The magnesium alloy obtained in this embodiment has both high strength and high elongation. The typical tensile curve of the magnesium alloy obtained in this example is shown in FIG. 1.

Figure 4:
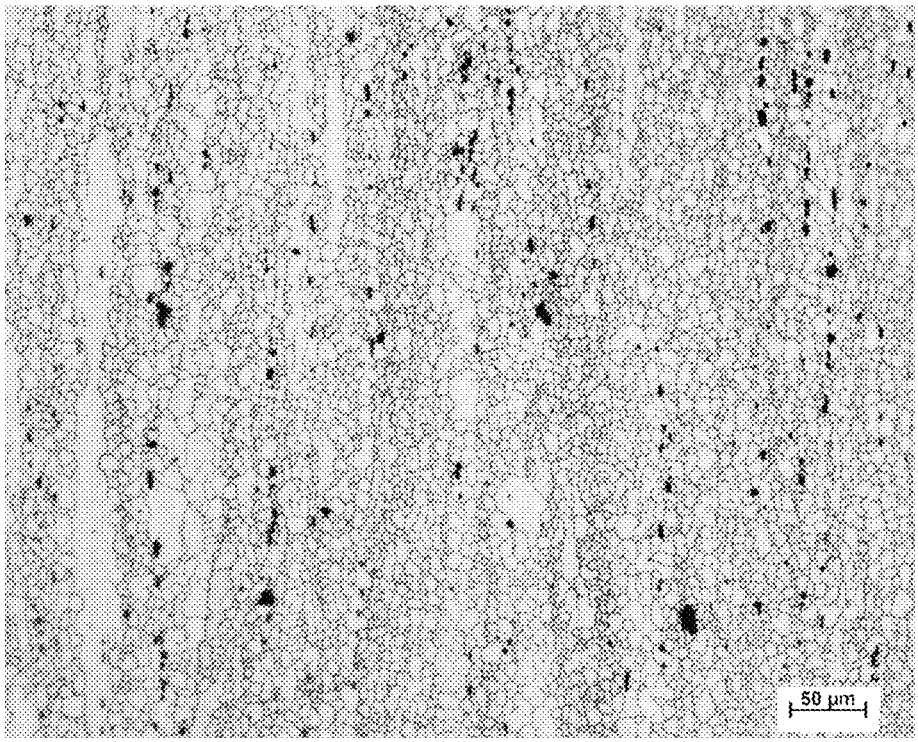
FIG. 4 is a microstructure of embodiment 2 parallel to the extrusion direction.

A sample with a length of 90 mm is cut from the upper rim part (spinning area) of the hub obtained in Embodiment 2, and processed into a round bar-shaped tensile sample with a diameter of 5 mm and a gauge length of 25 mm for the tensile test. The axial direction of the sample bar is the same as the metal streamline direction of the material. It is measured that the tensile strength of the magnesium alloy of the present disclosure is 289 MPa, the yield strength is 230 MPa, and the elongation rate is 9.9%, as shown in table 2. The magnesium alloy obtained in this embodiment has both high strength and high elongation. The typical tensile curve of the magnesium alloy obtained in this example is shown in FIG. 1. FIG. 4 is a microstructure morphology of the Mg-4.47Al-1.09Zn-0.58Mn-0.28Sr (wt. %) magnesium alloy obtained in this example parallel to the extrusion direction. It can be seen that the alloy undergoes dynamic recrystallization during the spinning process, and the proportion of fine grains accounts for 92%.

Embodiment 3: The Mg-3.35Al-0.92Zn-0.43Mn-0.21Sr (wt. %) alloy composition ratio is selected to form a magnesium alloy. The preparation method comprises the following steps.

(1) Batching: using pure Mg ingots, pure Al blocks, pure Zn blocks, MgMn master alloys, and MgSr master alloys as raw materials, and batching according to the above-mentioned target composition.

(2) Smelting: putting the pure Mg ingot into the crucible of the smelting furnace, setting the furnace temperature at 710° C. and keeping it, s, adding the pure Al and pure Zn blocks preheated to 65° C. into the magnesium solution after smelting, then raising the melting temperature to 760° C., adding the MgMn master alloy preheated to 65° C. and MgSr master alloy preheated to 120° C. into the magnesium solution respectively, keeping it for 15 minutes, then stirring for 5 minutes, and introducing the high-purity Ar gas for refining and degassing, adjusting and controlling the temperature at 72° C. for 8 minutes; the smelting process is carried out under the protection of a mixed gas of $CO_2$ and $SF_6$.

(3) Pouring: removing the surface scum and pouring the magnesium alloy melt into a corresponding die to prepare the as-cast magnesium alloy; the casting temperature is controlled above 700° C., and the casting process does not require gas protection.

(4) Stress relief treatment: keeping the temperature at 300° C. for 10 h, and then air cooling.

The ingot after solution treatment obtained in the previous step is cut into corresponding blanks and peeled them.

(5) Extruding and deforming: heating the blank obtained in the previous step to 380° C. within 30 minutes, and putting the blank into a die for deforming; the extrusion speed is 7.2 m/min, air cooling is carried out after deforming and finally the plastic magnesium alloy material is obtained.

The preparation of wheels from the above-mentioned magnesium alloy materials comprises forging and spinning: (1) forging the shaped magnesium alloy materials described in the previous step on a 6000-ton forging equipment with a forging temperature of 380° C.; (2) rim spinning the wheel rim after forging, the spinning temperature is 340° C., the feeding speed of the spinning wheel is 350 mm/min, the wall thickness reduction rate is 70%, and the spindle speed is 400 r/min and finally the magnesium alloy wheel hub is obtained.

A sample with a length of 90 mm is cut from the cast bar obtained in Embodiment 1, and processed into a round bar-shaped tensile sample with a diameter of 5 mm and a gauge length of 25 mm for the tensile test. It was measured that the tensile strength of the magnesium alloy of the present disclosure is 209 MPa, the yield strength is 65.3 MPa, and the elongation is 18.9%, as shown in table 1. The magnesium alloy obtained in this embodiment has both high strength and high elongation. The typical tensile curve of the magnesium alloy obtained in this example is shown in FIG. 1.

Figure 5:
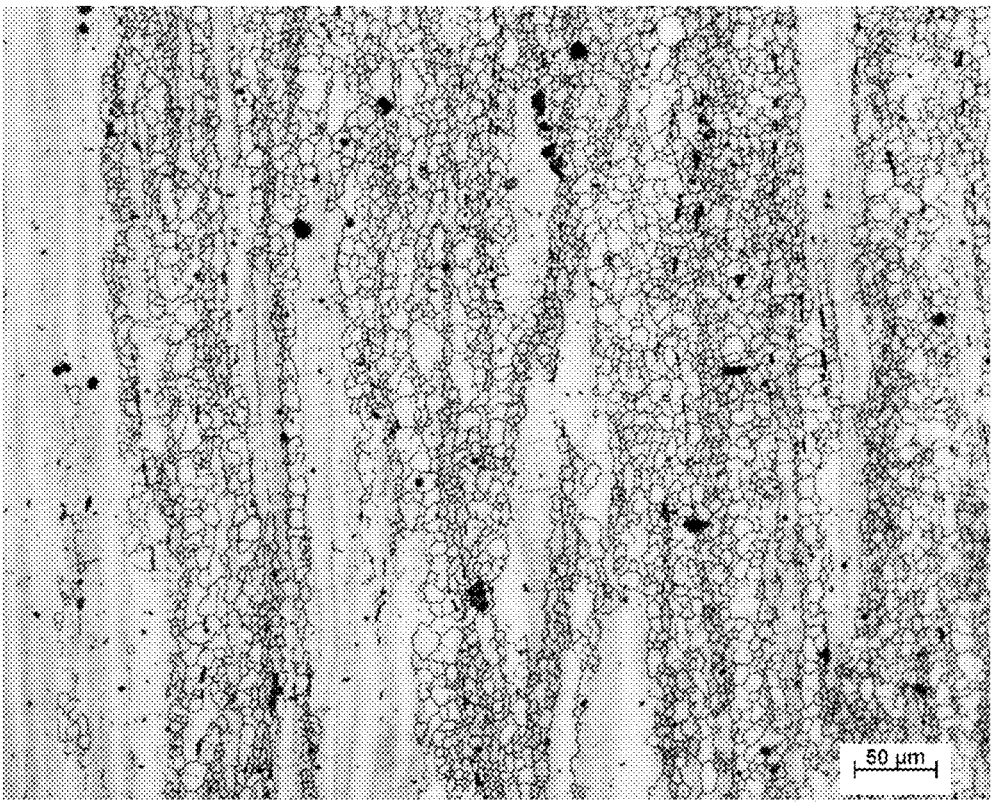
FIG. 5 is a microstructure of embodiment 3 parallel to the extrusion direction.

A sample with a length of 90 mm is cut from the upper rim part (spinning area) of the hub obtained in embodiment 3, and processed into a round bar-shaped tensile sample with a diameter of 5 mm and a gauge length of 25 mm for the tensile test. The axial direction of the sample bar is the same as the metal streamline direction of the material. It is measured that the tensile strength of the magnesium alloy of the present disclosure is 279 MPa, the yield strength is 215 MPa, and the elongation is 10.6%, as shown in table 2. The magnesium alloy obtained in this embodiment has both high strength and high elongation. The typical tensile curve of the magnesium alloy obtained in this example is shown in FIG. 2. FIG. 5 shows a microstructure morphology of the Mg-3.35Al-0.92Zn-0.43Mn-0.21Sr (wt. %) magnesium alloy obtained in this embodiment parallel to the extrusion direction. It can be seen that its characteristics are similar to those of Embodiment 1 and Embodiment 2. The alloy undergoes dynamic recrystallization during the spinning process, and the proportion of fine grains is 87%.

The comparison is current commercial AZ31 magnesium alloy: Mg-2.8Al-0.9Zn-0.3Mn (wt. %) magnesium alloy. A sample with a length of 90 mm is cut from the alloy cast bar obtained in the comparison and processed into a round bar-shaped tensile sample with a diameter of 5 mm and a gauge length of 25 mm for the tensile test. It is measured that the tensile strength of the magnesium alloy of the present disclosure is 121 MPa, the yield strength is 51.4 MPa, and the elongation is 11%, as shown in table 1. The magnesium alloy obtained in this embodiment has relatively low strength and medium elongation. The typical tensile curve of the magnesium alloy obtained in this example is shown in FIG. 1.

On the hub obtained in the comparison (forging conditions: spinning temperature 340° C., rotary wheel feeding speed 300 mm/min, wall thickness reduction rate 60%, spindle speed 300 r/min), the measured tensile strength of the magnesium alloy of the present disclosure is 243 MPa, the yield strength is 137 MPa, and the elongation is 7%. As shown in table 2. The typical stress-strain curve in the tensile test is shown in FIG. 2.

Figure 6:
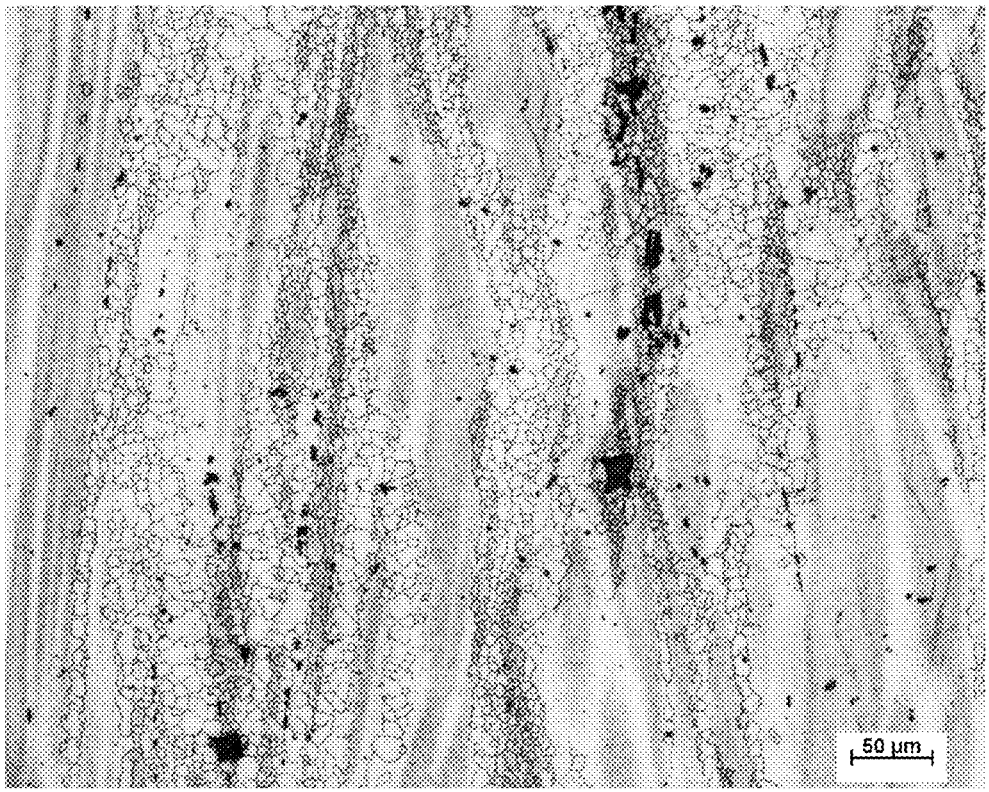
FIG. 6 is a microstructure of the comparison parallel to the extrusion direction.

By comparison, it can be seen that the room temperature strength and elongation of the novel magnesium alloy of the present disclosure are extremely significantly improved compared to the alloy of the comparative example. It achieves the same effect as the alloy after large-scale addition of rare earth elements and large plastic deformation. It is a new low-cost, high-strength and tough magnesium alloy material that is very competitive in the field of preparing magnesium alloy wheels. FIG. 6 shows the microstructure of the AZ31 magnesium alloy made in the comparison parallel to the extrusion direction. The alloy undergoes incomplete dynamic recrystallization during the spinning process, and the proportion of fine grains is 53%.

The raw materials and equipment used in the above-mentioned embodiments are all obtained by known ways, and the operation process used is mastered by those skilled in the art.

TABLE 1

| | Alloy composition (wt %) | Tensile strength MPa | Yield strength MPa | Elongation % |
|---|---|---|---|---|
| Test results of tensile mechanical properties at room temperature in the as-cast state of the embodiments and comparison | | | | |
| Embodiment 1 | Mg—2.42Al—0.71Zn—0.52Mn—0.15Sr | 208 | 70.2 | 19.2 |
| Embodiment 2 | Mg—4.47Al—1.09Zn—0.58Mn—0.28Sr | 209 | 65.7 | 22.1 |
| Embodiment 3 | Mg—3.35Al—0.92Zn—0.43Mn—0.21Sr | 209 | 65.3 | 18.9 |
| Comparison | AZ31 | 121 | 51.4 | 11 |
| Test results of tensile mechanical properties at room temperature in the variant state of the embodiments and comparison. | | | | |
| Embodiment 1 | Mg—2.42Al—0.71Zn—0.52Mn—0.15Sr | 282 | 223 | 11 |
| Embodiment 2 | Mg—4.47Al—1.09Zn—0.58Mn—0.28Sr | 289 | 230 | 9.9 |
| Embodiment 3 | Mg—3.35Al—0.92Zn—0.43Mn—0.21Sr | 279 | 215 | 10.6 |
| Comparison | AZ31 | 243 | 137 | 7 |

What is claimed is:

1. A method for preparing a magnesium alloy wheel comprising:

(1) a batching process, batching in mass percentage: Al: 2.4-4.5 wt. %; Zn: 0.6-1.2 wt. %; Mn: 0.4-0.6 wt. %; Sr: 0.15-0.3 wt. %, the balance being Mg for batching;

(2) a smelting process, putting a pure Mg ingot into a crucible of a smelting furnace, setting the furnace temperature at 700-730° C. and keeping it, adding a pure Al block and a pure Zn block preheated to 50-80° C. into magnesium solution after smelting, then raising the smelting temperature to 760-770° C., and adding Mg—Mn master alloy and Mg—Sr master alloy preheated to 120-140° C. into the magnesium solution respectively; then raising the smelting temperature to 780° C., keeping the temperature for 5-15 minutes, then stirring for 3-10 minutes, and introducing high-purity Ar gas for refining and degassing, adjusting and controlling the temperature at 710° C.-730° C., keeping the temperature for 2-10 minutes;

(3) a pouring process at a pouring temperature controlled above 700° C.;

(4) a stress relief treatment process, keeping the temperature at 280-320° C. for 8-12 h, then air cooling, thereby forming a magnesium alloy;

(5) an extruding and deforming process, heating the magnesium alloy to 320-380° C. within minutes, then putting the magnesium alloy into a die for deformation processing; the at an extrusion speed being 1-10 m/min, and air cooling after deformation processing;

(6) a forging process, forging the magnesium alloy into a cylindrical shape; and (7) a rim spinning process, rim spinning the magnesium alloy in a spinning equipment.

2. The method according to claim 1, wherein the smelting process is carried out under the protection of a mixture of $CO_2$ and $SF_6$ gas.

3. The method according to claim 2, wherein the composition volume ratio of the mixed gas of $CO_2$ and $SF_6$ is 50-100:1.

4. The method according to claim 1, wherein after the smelting process is completed, surface scum needs to be removed and pour the solution into a die to obtain the magnesium alloy.

5. The method according to claim 1, wherein, after the stress relief treatment process, a process of cutting into blanks and peeling is also comprised before the extruding and deforming process.

6. The method according to claim 1, wherein the stirring in the smelting process comprises mechanical stirring and argon stirring.

7. The method according to claim 1, wherein the Al—Mn master alloy is a Mg-10Mn master alloy, and the Mg—Sr master alloy is a Mg-25Sr master alloy.

8. The method according to claim 1, wherein the forging equipment is a 6000-ton forging equipment; and the rim spinning process is carried out at a spinning temperature of 300° C.-380° C., a rotary wheel feeding speed of 350-450 mm/min, a wall thickness reduction rate of 60-75%, and a spindle speed of 300-400 r/min.

* * * * *